US008866083B2

(12) United States Patent
Brigham et al.

(10) Patent No.: US 8,866,083 B2
(45) Date of Patent: Oct. 21, 2014

(54) ALARM

(75) Inventors: Peter Brigham, Coventry (GB); Stuart Hart, Coventry (GB)

(73) Assignee: Sprue Safety Products, Ltd., London (GB)

( * ) Notice: Subject to any disclaimer, the term of this patent is extended or adjusted under 35 U.S.C. 154(b) by 0 days.

(21) Appl. No.: 13/642,201

(22) PCT Filed: Apr. 20, 2011

(86) PCT No.: PCT/GB2011/000614

§ 371 (c)(1),
(2), (4) Date: Oct. 19, 2012

(87) PCT Pub. No.: WO2011/131937

PCT Pub. Date: Oct. 27, 2011

(65) Prior Publication Data

US 2013/0033699 A1 Feb. 7, 2013

(30) Foreign Application Priority Data

Apr. 21, 2010 (GB) ..... 1006680.1

(51) Int. Cl.
*G08B 17/107* (2006.01)
*G08B 29/24* (2006.01)

(52) U.S. Cl.
CPC ..... *G08B 17/107* (2013.01); *G08B 29/24* (2013.01)
USPC ..... 250/338.1

(58) Field of Classification Search
CPC ..... G08B 17/107
USPC ..... 250/336.1, 338.1; 356/51
See application file for complete search history.

(56) References Cited

U.S. PATENT DOCUMENTS 2,298,757 A 10/1942 Evans et al.
3,946,241 A 3/1976 Malinowsky (Continued)

FOREIGN PATENT DOCUMENTS

JP 54083491 A 7/1979
JP 61172034 A 8/1986

OTHER PUBLICATIONS

International Search Report dated Aug. 17, 2010 for Great Britain application No. GB1006680.1.

(Continued)

*Primary Examiner* — David Porta
*Assistant Examiner* — Faye Boosalis
(74) *Attorney, Agent, or Firm* — Ohlandt, Greeley, Ruggiero & Perle, LLP

(57) ABSTRACT

An optical smoke detector (10) is provided that comprises a light source (154), a light receiver (172), and a control circuit (130) for controlling operation of the detector. The control circuit (130) is configured to apply an unregulated voltage to the light source to cause it to emit light, to monitor the current through said light source (154) so as to monitor the light emitted by said light source (154); and to monitor the current generated by light received by said light receiver (172) so as to monitor the light received by said light receiver (172). The control circuit (130) generates a ratio signal representative of the ratio of the monitored currents; and compares the ratio signal with a reference value and generate a smoke detection signal in dependence thereon.

17 Claims, 4 Drawing Sheets

(56) References Cited

U.S. PATENT DOCUMENTS

| | | | | |
|---|---|---|---|---|
| 4,695,734 | A | 9/1987 | Honma et al. | |
| 4,870,394 | A | 9/1989 | Corl et al. | |
| 6,155,160 | A * | 12/2000 | Hochbrueckner | 99/331 |
| 7,167,099 | B2 * | 1/2007 | Kadwell et al. | 340/630 |
| 7,847,700 | B2 * | 12/2010 | Conforti | 340/630 |
| 2012/0140231 | A1 * | 6/2012 | Knox et al. | 356/442 |

OTHER PUBLICATIONS

International Search Report dated Aug. 3, 2011 corresponding to International Patent Application No. PCT/GB2011/000614.

International Preliminary Report on Patentability dated Jul. 30, 2012 corresponding to International Patent Application No. PCT/GB2011/000614.

* cited by examiner

ALARM

The present invention relates to optical smoke detectors.

Optical smoke alarms use an infra-red emitter LED which is usually driven from a constant current source. The level of the signal generated by the infra-red receptor from light reflected off the smoke is compared to a fixed reference to determine whether or not an alarm threshold of smoke has been reached.

The present invention seeks to provide an improved optical smoke detector.

Accordingly, the present invention provides an optical smoke detector comprising: a light source; a light receiver; and a control circuit for controlling operation of the detector; wherein said control circuit is configured to: apply an unregulated voltage to the light source to cause it to emit light; monitor the current through said light source so as to monitor the light emitted by said light source; monitor the current generated by the light received by said light receiver so as to monitor the light received by said light receiver; generate said ratio signal representative of the ratio of the monitored currents; and compare said ratio signal with a reference value and generate a smoke detection signal in dependence thereon.

By using an unregulated supply and monitoring the actual current through the light source and light receiver, and then determining a ration of the two, as opposed to relying on a regulated supply for constant light output and comparing the received light to a preset entity the detector circuitry can be greatly simplified and components eliminated, in particular the need for a regulated voltage supply is removed.

Preferably the light source is an LED and preferably the current through said light source is in the linear range of the LED. In one arrangement the light source may be unregulated and the current through said light source may be in the range 200 mA to 600 mA.

Preferably, said light source is driven by a high-side semiconductor device and said control circuit is configured to switch said high-side semiconductor device ON for a preselected time period at preselected time intervals.

Said preselected time period is typically 100 μs and said preselected time interval is typically 10 seconds.

Preferably said light source is a Light Emitting Diode and conveniently said light is infra-red light.

The present invention also provides a method of operating an optical smoke detector comprising a light source and a light receiver, the method comprising: energising said light source with an unregulated voltage to cause said light source to emit light; monitoring the current through said light source so as to monitor the light emitted by said light source; monitoring current through said light receiver so as to monitor the light received by said light receiver; determining the ratio of the monitored currents to provide a ration indicative of the ratio of said received and emitted light; comparing said ratio with a reference value; and generate a smoke detection signal in dependence thereon.

Preferably the current through said light source is. In one arrangement the light source may be unregulated and the current through said light source may be in the range 200 mA to 600 mA.

Preferably, the current through said light source is in the linear range of the LED. In one arrangement the light source may be unregulated and the current through said light source may be in the range 200 mA to 600 mA.

Advantageously, said light source is energised for a preselected time period at preselected time intervals.

Preferably, said light source is driven by a high-side semiconductor device and the method comprises switching said high-side semiconductor device ON for a preselected time period at preselected time intervals.

Typically, said preselected time period is 100 μs and said preselected time interval is 10 seconds.

Advantageously, said light source is a Light Emitting Diode and said light is infra-red light.

The present invention is further described hereinafter, by way of example, with reference to the accompanying drawings, in which.

Figure 1:
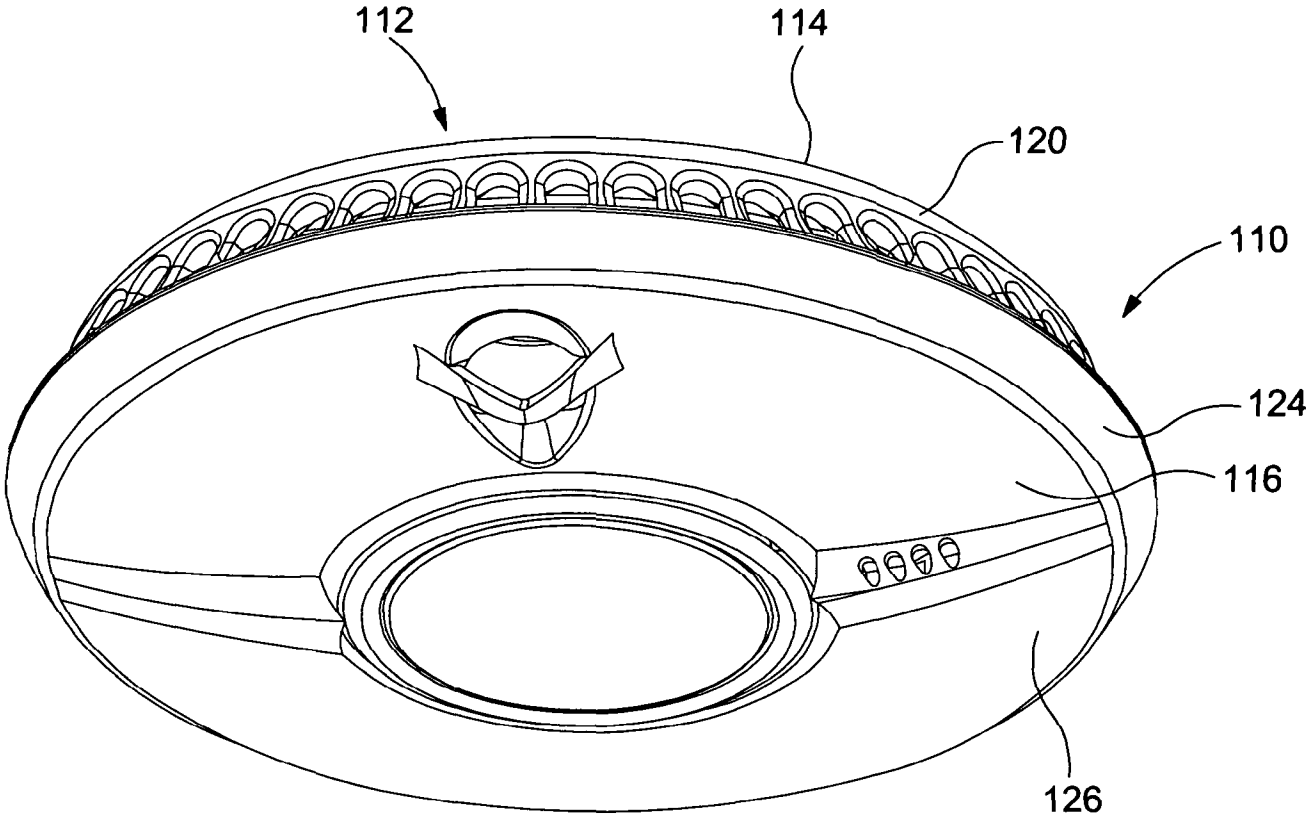
FIG. 1 is a perspective view from below of a preferred form of alarm according to the present invention.
Figure 2:
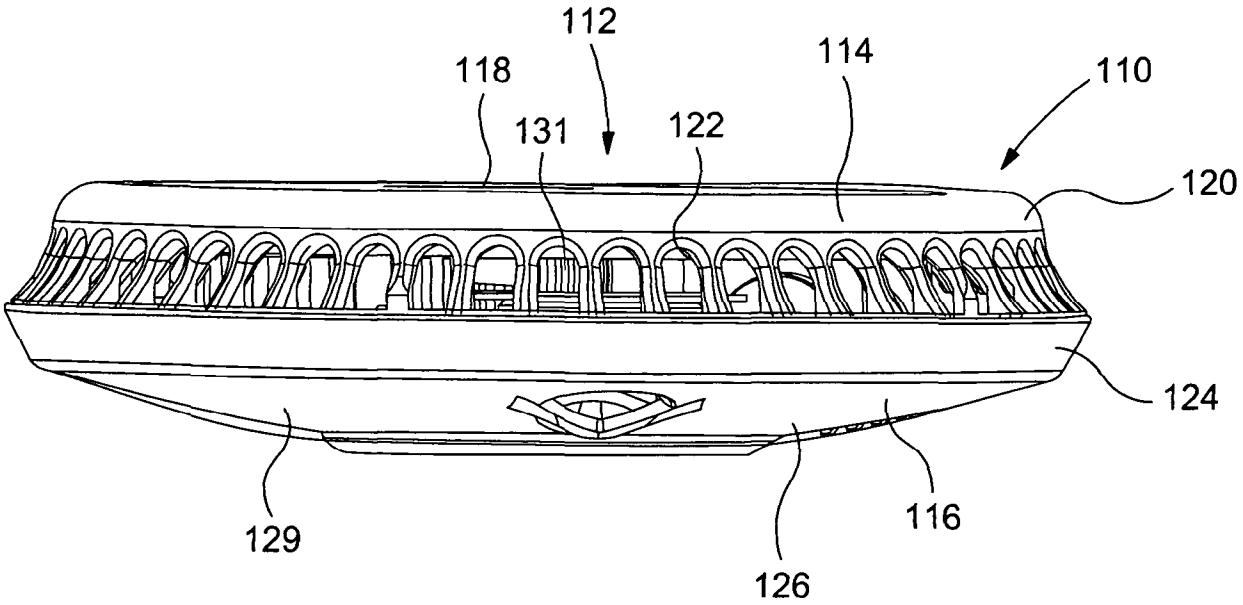
FIG. 2 is a side elevation of the alarm of FIG. 1.

Referring to the drawings these show a preferred form of optical smoke alarm 110 having a housing 112 which has a base 114 and a cover 116. The base enables the alarm to be attached to a surface such as a room ceiling by suitable means. The base has a generally planar bottom wall 118 for abutment with the ceiling or an intervening mounting plate, and a side wall 120. The latter has a plurality of openings 122 arranged along its circumference to allow the ingress of smoke and the like. The cover 116 is generally "cup" or "saucer shaped" having a side wall 124 and a bottom wall 126 defining the interior of the cover. The bottom wall 126 has an internal surface (not shown) generally facing towards the base 114.

The alarm has an optical sensor 131 and a control circuit 130 preferably contained within the housing between the internal surface 127 and the base 114, the control circuit controlling operation of the detector. The alarm may also contain a sounder 132 (FIG. 3) for sounding an audible alarm when triggered by the control circuit in response to signals received from the sensor. Alternatively or additionally the sounder may be located remote from the alarm and activated by radio or other wireless signal transmission.

Figure 3:
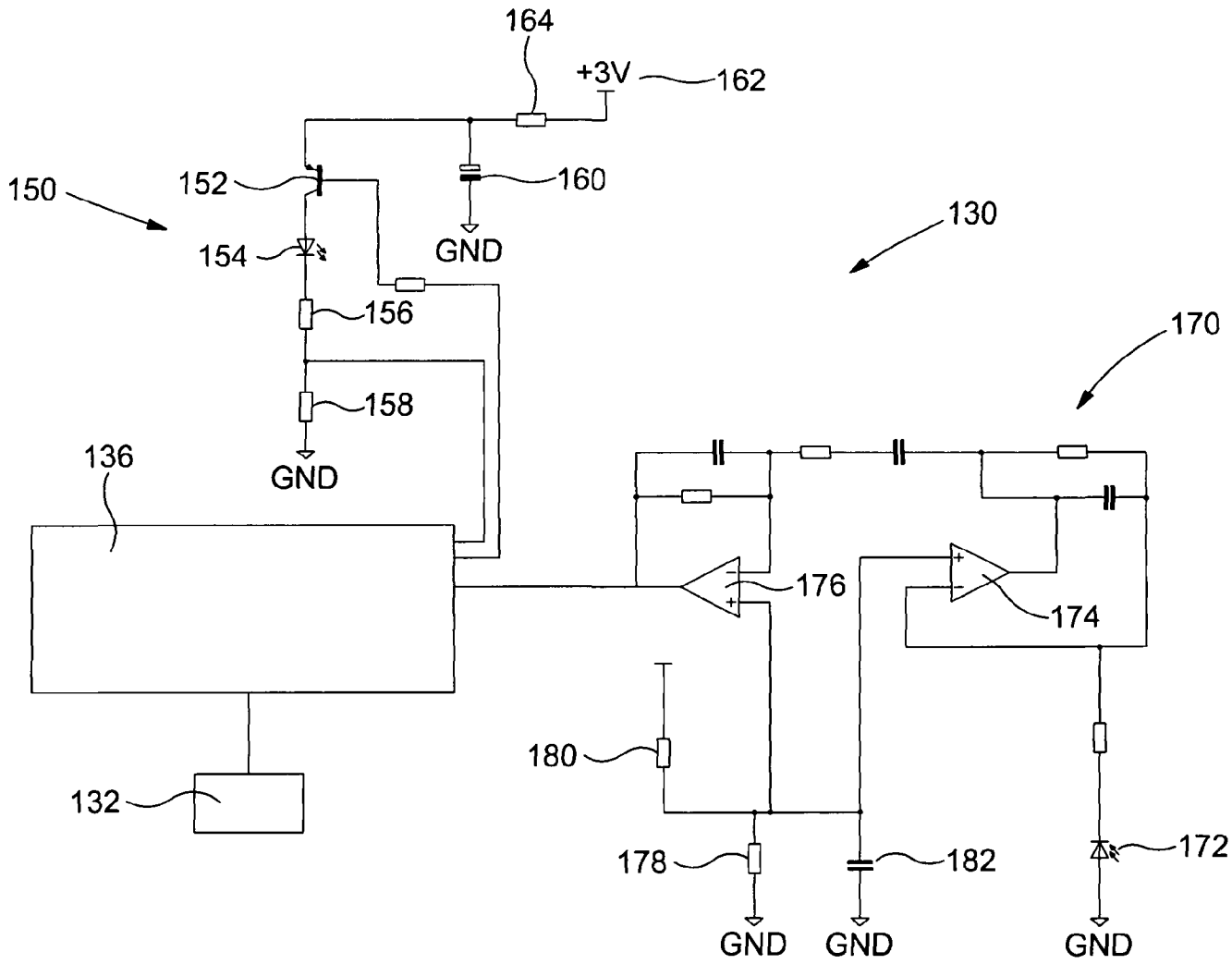
FIG. 3 is a circuit diagram of a portion of a control circuit for the alarm of FIG. 1.

Referring to FIG. 3 this shows a light emitter circuit 150 of the control circuit 130 in which a high-side driver gate 152 is used to switch current into a light source 154 of the optical sensor 131. In the illustrated embodiment the high-side driver gate is a transistor but any suitable semiconductor device may be used. The light source is preferably a light emitting diode (LED) and the emitted light is preferably infra-red (IR) light. Conventional methods typically use a low side driver transistor (e.g. NPN transistor) that regulates the current. However, this requires a higher minimum supply voltage to ensure regulation. In the preferred embodiment of FIG. 3 the transistor 152 is switched fully on to drive the LED 154 and current is not regulated.

Current limiting means are used to limit the current through the light source 154. In the illustrated embodiment the current limiting means are formed by a voltage divider resistance chain comprising resistors 156, 158. The emitter of the transistor 152 is connected to a power supply line 162, typically +3 v, and a reservoir capacitor 160 is connected between the emitter and the supply line. The capacitor is charged whilst the transistor is in its OFF state and discharges through the transistor 152 and LED 154 when the transistor 152 is switched ON to provide a high current pulse to the LED 154 periodically without taking excessive current drain from the battery. A resistor 164 connecting the emitter and capacitance 160 to the power supply line allows the capacitor to recharge whilst the transistor is in its OFF state.

The value of the current through the light source 154 can be determined by measuring the voltage across resistor 158 and this is applied to an input terminal of the microprocessor 136.

The resistors 156, 158 act as a voltage divider and reduce the voltage to an acceptable level for the microprocessor 136, ensuring that the voltage input to the microprocessor 136 does not exceed specified range.

The control circuit 130 also has a sensing circuit 170 for monitoring the light received by the light receiver 172 of the optical sensor 131. The light receiver is in the form of a receiver diode coupled to one input (the inverting input) of an operational amplifier 174 of the circuit 170. The other input of the operational amplifier is connected to a voltage reference level formed by resistors 178, 180 in the form of a voltage divider, whilst its output is further amplified by a second operational amplifier 176 and applied to an input of the microcontroller 136.

The resistors 178, 180 and capacitance 182 provide a bias voltage for the sensing circuit 170. All of the operational amplifier voltages stabilise to this voltage on power-up so the stabilisation time on power-up (due to capacitors being charged) is very short. When the circuit is powered by battery the circuit will typically be powered for as short a time as possible to minimise current drain.

Normally the control circuit 130 will be in sleep mode, waking at preselected time intervals to check the presence or absence of smoke. When the control circuit switches to wake mode, it applies a turn on pulse (in this embodiment a negative going pulse) to the base of transistor 152, turning the transistor ON and partially discharging the capacitance 160 through the LED 154. The current through the LED creates a voltage drop across resistor 158 which is monitored by the microprocessor 136. Typically, transistor 152 is switched on for approximately 100 μs every 10 seconds.

When the LED 154 is energized to emit light the receiver diode 172 produces a current that is proportional to the IR radiation received. This is amplified to produce a signal on the output of amplifier 174. This signal is further amplified by amplifier 176. A certain level of IR radiation will always be received due to reflections from surfaces internal to the smoke sensing chamber of the sensor 131 built around the LED 154 and the receiver diode 172. When smoke enters the chamber more radiation will be reflected from the smoke and the amount of radiation incident on the receiver diode 172 will increase. The output signal of amplifier 176 will therefore increase if other operating conditions remain unchanged.

Figure 4A:
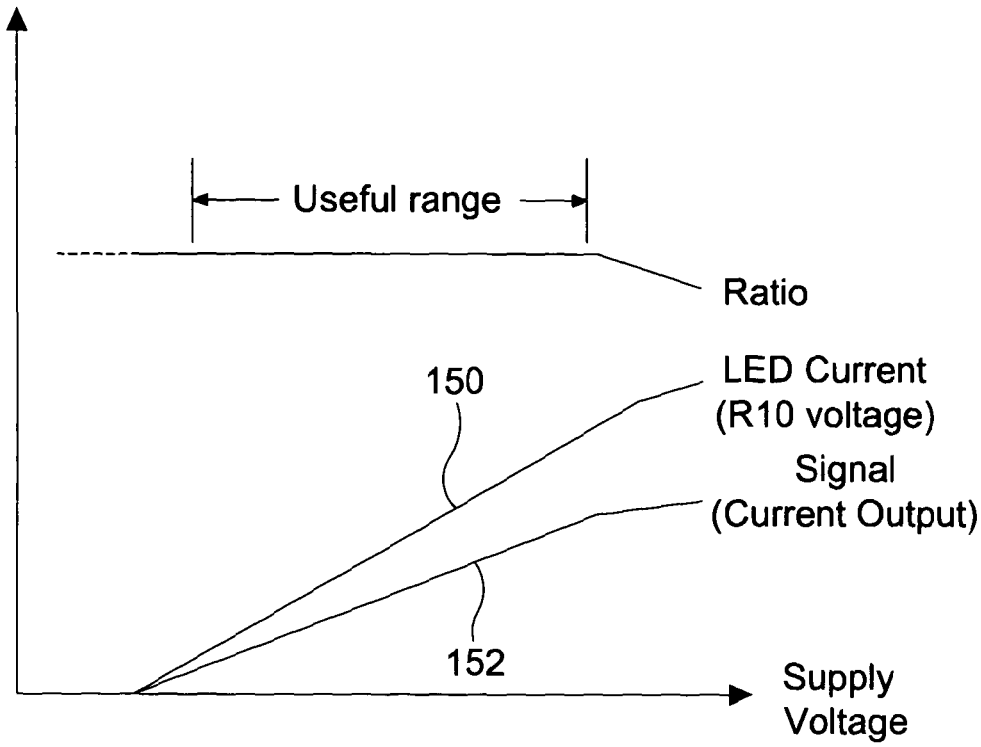
FIGS. 4*a* and 4*b* are graphs illustrating the operation of the control circuit.

Referring now to FIG. 4*a*, this shows the response of the sensing circuit 170 in clean air. The current through the IR emitting diode 154 is measured indirectly using the series resistor 158. The variation in this current through the diode with changing supply voltage, and therefore the variation in the light output of the LED 154, is shown in curve 150. The variation in the current generated by the receiving diode 172 with incident light, and measured by the sensing circuit 170, is also shown in curve 152.

For a very low supply voltage there is not enough voltage to drive current through the emitting diode 154. As the threshold voltage of this diode is reached the current increases. Within a fairly wide range of emitting diode currents the ratio between the diode current (i.e. emitted light) and the current generated by the receiver diode 172 in response to the incident radiation is relatively constant. A typical useful range of emitting diode currents is 200 mA to 600 mA and the values of components and supply voltages are selected to ensure that when the transistor 154 is pulsed ON the current through the LED 154 is always within this range.

Figure 4B:
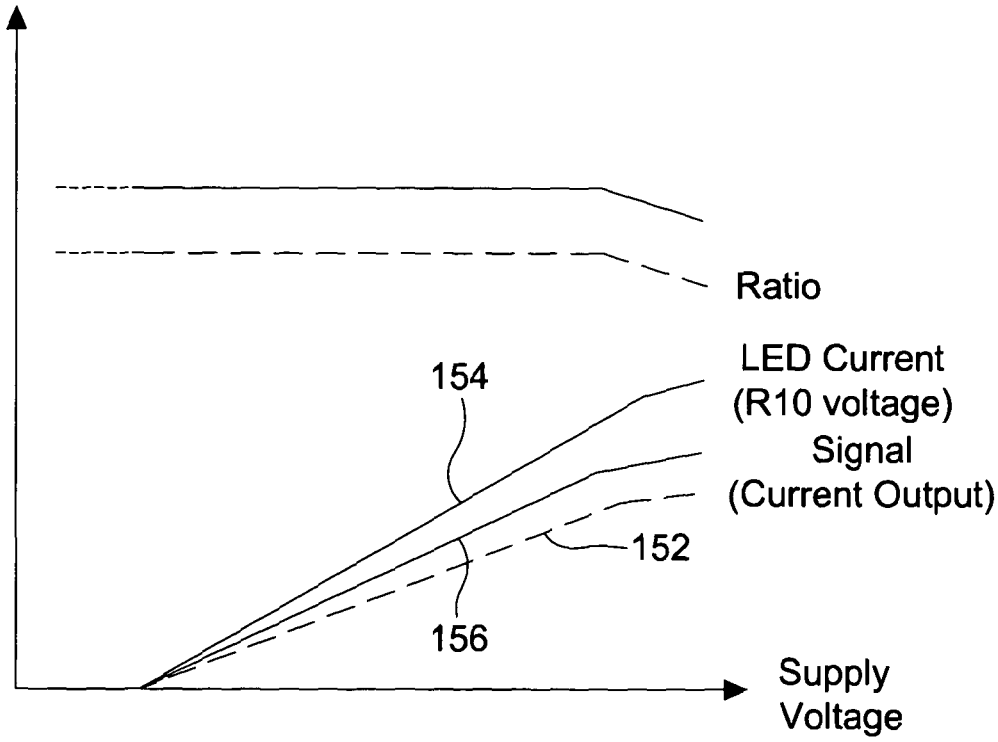

If smoke enters the optical sensor chamber 131 then the amount of reflected light incident on the receiver diode 172 increases, and the current through diode 172 therefore increases. FIG. 4*b* shows the response of the diodes when the chamber is partially or fully filled with smoke. The LED (emitted) current shown in curve 154 is unaffected. However, the current generated by the receiver diode 172 increases as shown in curve 156 above that shown in curve 152.

The current level through the LED 154 and the corresponding current generated in the receiver diode 172 are monitored by the microprocessor 136 which generates a ratio signal which is representative of the ratio of the received light and the emitted light. The microprocessor then compares this ratio signal with a reference value and if the ratio signal exceeds the preselected reference value it triggers an alarm signal.

The responses of the IR LED 154 and detector diode 172 are effectively linear over a wide operating range. Thus, for a given level of incident light the ratio of these two signals is constant. This calculated ratio is compared against a calibrated reference value to determine whether or not a critical level of smoke has been reached.

The ratio will increase with increasing smoke level and, as in the 'clean air' condition, the ratio is independent of emitted light and therefore LED 154 current over a wide range.

The current ratio is therefore independent of supply voltage (within design limits) and an increase in this ratio indicates an increase in smoke density.

The above described and illustrated alarm does not use a constant current source. Instead, it uses an unregulated supply to drive the light source. The LED current is measured and the ratio of received signal to LED current is then compared against a reference.

As a result, a low voltage overhead is required to drive the LED (no linear regulator is needed) and thus a lower voltage supply can be used, such as a 3 v cell, without step-up circuits.

Accuracy is also improved. In conventional circuits, ASICs (Application Specific Integrated Circuits) provide a regulated output voltage that drives a separate transistor/emitter resistor combination to provide a nominally constant current. This current varies significantly with temperature.

The control circuit 130 also uses fewer components than conventional alarm circuits, resulting in higher reliability and lower cost.

The invention claimed is:

1. An optical smoke detector comprising:

a light emitting diode;

a light receiver;

and a control circuit for controlling operation of the detector;

wherein said control circuit is configured to apply an unregulated voltage to the light emitting diode to cause it to emit light;

monitor the current through said light emitting diode so as to monitor the light emitted by said light emitting diode;

monitor the current generated by light received by said light receiver so as to monitor the light received by said light receiver;

generate a ratio signal representative of the ratio of the monitored currents; and compare said ratio signal with a reference value and generate a smoke detection signal in dependence thereon.

2. A detector as claimed in claim 1 wherein the current through said light emitting diode is in the linear current range of the light emitting diode.

3. A detector as claimed in claim 2 wherein the current through said light emitting diode is in the range 200 mA to 600 mA.

4. A detector as claimed in claim 1 wherein the current through said light emitting diode is in the range 200 mA to 600 mA, and the ratio of the monitored currents is substantially constant for a given level of incident light and is therefore independent of supply voltage.

5. A detector as claimed in claim 1 wherein said light emitting diode is driven by a high-side semiconductor device and said control circuit is configured to switch said high-side semiconductor device ON for a preselected time period at preselected time intervals.

6. A detector as claimed in claim 5 wherein said preselected time period is 100 μs.

7. A detector as claimed in claim 5 wherein said preselected time interval is 10 seconds.

8. A detector as claimed in claim 1 wherein said light is infra-red light.

9. A method of operating an optical smoke detector comprising a light emitting diode and a light receiver, the method comprising:

energising said light emitting diode with an unregulated voltage to cause said light emitting diode to emit light;

monitoring the current through said light emitting diode so as to monitor the light emitted by said light emitting diode;

monitoring current through said light receiver so as to monitor the light received by said light receiver;

determining the ratio of the monitored currents to provide a ratio indicative of the ratio of said received and emitted light;

comparing said ratio with a reference value;

and generate a smoke detection signal in dependence thereon.

10. A method as claimed in claim 9 wherein the current through said light emitting diode is in the linear range of the light emitting diode.

11. A method as claimed in claim 10 wherein the current through said light emitting diode is in the range 200 mA to 600 mA.

12. A method as claimed in claim 9 wherein the current through said light emitting diode is in the range 200 mA to 600 mA, and the ratio of the monitored currents is substantially constant for a given level of incident light and is therefore independent of supply voltage.

13. A method as claimed in claim 9 wherein said light emitting diode is energised for a preselected time period at preselected time intervals.

14. A method as claimed in claim 13 wherein said light emitting diode is driven by a high-side semiconductor device and the method comprises switching said high-side semiconductor device ON for a preselected time period at preselected time intervals.

15. A method as claimed in claim 13 wherein said preselected time period is 100 μs.

16. A method as claimed in claim 13 wherein said preselected time interval is 10 seconds.

17. A method as claimed in claim 9 wherein said light is infra-red light.

* * * * *